US012228008B2

(12) United States Patent
Khomsanit et al.

(10) Patent No.: US 12,228,008 B2
(45) Date of Patent: Feb. 18, 2025

(54) COMPLETION PLUG FOR WELL COMPLETION

(71) Applicant: PTT Exploration and Production Public Company Limited, Bangkok (TH)

(72) Inventors: Nattawit Khomsanit, Bangkok (TH); Putip Dolchalermkiat, Bangkok (TH); Thanakorn Cherdvorapong, Bangkok (TH)

(73) Assignee: PTT Exploration and Production Public Company Limited, Chatuchak (TH)

( * ) Notice: Subject to any disclaimer, the term of this patent is extended or adjusted under 35 U.S.C. 154(b) by 376 days.

(21) Appl. No.: 17/334,612

(22) Filed: May 28, 2021

(65) Prior Publication Data

US 2021/0285304 A1 Sep. 16, 2021

Related U.S. Application Data

(63) Continuation of application No. PCT/TH2019/000062, filed on Nov. 27, 2019.

(30) Foreign Application Priority Data

Nov. 28, 2018 (TH) ..... 1801007348

(51) Int. Cl.
*E21B 33/12* (2006.01)
*E21B 34/10* (2006.01)

(52) U.S. Cl.
CPC ..... *E21B 33/12* (2013.01); *E21B 34/101* (2013.01)

(58) Field of Classification Search
CPC ..... E21B 34/101
See application file for complete search history.

(56) References Cited

U.S. PATENT DOCUMENTS 3,314,480 A * 4/1967 Scott ..... E21B 33/1265 166/149
4,149,593 A 4/1979 Gazda et al.
(Continued)

FOREIGN PATENT DOCUMENTS

| | | |
|---|---|---|
| CA | 2797485 A1 | 5/2013 |
| WO | 0248502 | 6/2002 |
| WO | 2007049046 A1 | 5/2007 |

OTHER PUBLICATIONS

International Search Report dated May 26, 2020 in connection with International Patent Application No. PCT/TH2019/000062, 3 pages.
(Continued)

*Primary Examiner* — Theodore N Yao
(74) *Attorney, Agent, or Firm* — Baker & McKenzie LLP

(57) ABSTRACT

Embodiments relate to a completion plug having a running tool including a safety assembly housed in the running tool. The completion plug includes an equalizing body housed in the running tool. The equalizing body includes an equalizing port. The equalizing body is formed as an elongated body having first and second ends. The equalizing body is arranged in the running tool in such a way that the safety assembly is provided between the upper part and the first end of the equalizing body. When the plug is provided in the well and a pressure differential is present in the well between upper and lower parts of the plug: the plug is configured to equalize the pressure differential via the equalizing port; and the safety assembly is configured to reduce an impact force applied between the first end of the equalizing body and the upper part of the running tool.

20 Claims, 3 Drawing Sheets

(56) References Cited

U.S. PATENT DOCUMENTS

| | | | | |
|---|---|---|---|---|
| 4,314,608 | A | 2/1982 | Richardson | |
| 4,374,543 | A | 2/1983 | Richardson | |
| 4,487,261 | A | 12/1984 | Gazda | |
| 4,646,829 | A * | 3/1987 | Barrington | E21B 23/06 166/135 |
| 5,054,558 | A * | 10/1991 | Barneck | E21B 33/12 166/373 |
| 6,467,547 | B2 | 10/2002 | Maguire et al. | |
| 2011/0203789 | A1 | 8/2011 | Gordon et al. | |
| 2013/0133891 | A1 | 5/2013 | Getzlaf et al. | |
| 2016/0168938 | A1* | 6/2016 | Pray | E21B 23/06 166/377 |

OTHER PUBLICATIONS

Written Opinion of the ISR dated May 26, 2020 in connection with International Patent Application No. PCT/TH2019/000062, 3 pages.
International Preliminary Report on Patentability dated May 25, 2021 in connection with International Patent Application No. PCT/TH2019/000062, 4 pages.

* cited by examiner

COMPLETION PLUG FOR WELL COMPLETION

CROSS-REFERENCE TO RELATED APPLICATIONS

This application is a continuation of and claims priority to International Application No. PCT/TH2019/000062, filed on Nov. 27, 2019, titled "Completion Plug for Well Completion," which claims priority to Thailand Application No. 1801007348 filed on Nov. 28, 2018, both of which are incorporated by reference in their entirety for all purposes.

TECHNICAL FIELD

The present invention relates to the field of engineering, in particular, to the completion plug for well completion.

BACKGROUND OF THE INVENTION

Well completion is a step that operates after well logging, starting with the installation of the casing hanger into the well and fixing the intermediate casing at the position close to the casing end. Cement is then fed along the production tubing by reversing the flow of cement back through the space between the production tubing and the well sidewall. This is done to separate the rock layer for producing petroleum from the other rock layers, preventing other fluids from the other rock layer to become contaminated, and preventing the petroleum from the desired production layer to flow into the above or underneath rock layers. Next, the production tubing is fixed and moved into the well at the desired depth.

After the well has been producing for a while, it is found that the production tubing is broken or there is obstacle in the tubing. The said damage significantly affects the production of the well. Therefore, the workover/recompletion needs to be performed to increase the production efficacy. After the recompletion, inspection is performed by sending the plug into the well. The plug should have a smaller diameter than the internal tubing and said plug will expand inside the tubing at the desired position in order to seal the tubing at the desired position. This seal obstructs the internal pressure and for testing the pressure of the liquid in the production tubing.

Before removing the plug to continue the production operation, pressures between the upper and the lower part of the plug need to be equalized in order to remove the plug easily and/or to prevent a pressure force that can jet up and cause a blow-out and fire danger.

Nevertheless, the completion plug for the pressure test tubing string has a problem in closing and opening of the pressure equalizing port. Therefore, attempts have been made to overcome said problem as stated in the following documents.

U.S. Pat. No. 4,314,608 discloses a device for maintaining the production tube cooperating with the packer for plugging the pressure or separating the isolate zone into two parts, which are the upper and the lower part of said device. This device comprises a plug that uses spring force to push between the shoulder of the internal part with the ball in order to close the equalizing port, and the seating tool, which is characterized as the housing on the upper part of the plug. When the well is needed to be plugged, the device is separated from the plugging part by the jarring down technique that shears the bolt fixed to both members, and allows the plug to become fixed on the packer. When the plug is needed to be retrieved from the well, the positioning part with the fishing neck is fed into the tubing to become fixed with the plug. Then the equalizing between the upper and the lower parts of the packer is performed using the jarring down technique to shear the bolt at the positioning part in order to open the equalizing port of the plug. However, this patent does not disclose the protection part for the impact occurring from the bolt shearing. Moreover, the closing of the equalizing port employs spring force that pushes the shoulder of the internal part to the ball in order to resist pressure. The spring becomes fatigued from high workloads.

U.S. Pat. No. 5,054,558 discloses a valve device for equalizing the pressure between the production tubing and the casting comprising of the first part, which is the housing for supporting the up and down sliding movement of the second member core for opening and closing the equalizing port; wherein the upper end of the second member core has a stopper for limiting the movement of second member. There is the orifice at the core connecting to the passageway that goes through the lower end of the second member. When there is no pressure equalizing, the shear screw fixes the first member to the second member. Nevertheless, when the screw is sheared with the jarring up technique, the second member moves down from the first member to the end and equalizes the pressure between the production tubing and the casting. However, the opening of the equalizing port of said device is jarring up in order to tear the shear screw, which may causes damage to the core of the second member. Moreover, the equalizing port of said device is designed to be small and needs a longer time when equalizing the different pressure between two positions.

U.S. Pat. No. 4,928,761 discloses a two-way plug comprising: 1) the running tool having an internal spring at the upper body and core inside the body next to the spring, with a slidable pin for limiting the movement of the core in the body; and 2) the plugging device connected to the lower part of the running tool comprising housing handle, which is the hollow rod extending into the housing, and the plug member having a spring covering and supporting the lowest part of the housing in order to prevent the equalizing port from opening. When needed to equalize the isolation zone, the running tool is jarring down to press open the equalizing port in order to equalize said isolation zone. However, the structure of said device is complicated and not suitable for working under high pressure conditions, including the time required to equalize in the isolation zone.

However, the plugs disclosed above have several limitations, especially in controlling the damage to the device and equalizing time. Additionally, the plugs disclosed above can only either equalize or plug. Therefore, this invention aims to develop the completion plug for well completion which has damage protection parts to protect the device and internal members. Additionally, this invention aims to shorten the equalizing time, and allows the selection of shearing the attaching means for which either equalizing or plugging the production tubing can occur.

SUMMARY OF INVENTION

The present invention relates to a completion plug for well completion

In one embodiment, the completion plug for equalizing pressure in well comprising:

A first attaching means (204) located between the upper part of a running tool (100) and a safety means (200), the safety means (200) comprising a equalizing shear sub (202), and the running tool (100) has internal space that allows internal members to move up and down;

A second attaching means (304) located between the middle part of the running tool (100) and a shearing means (300), the shearing means (300) comprising a shear retainer (302) for retaining shearing force that may occur between a fishing neck (410) and the inner of the running tool (100);

A third attaching means (422) located between the lower part of the running tool (100) and an equalizing means (400), an equalizing means (400) comprising a equalizing body (420) having an equalizing port (430) inside it and the fishing neck (410) for fishing the shearing means (300) to the equalizing means (400);

Wherein the completion plug is configured to equalize the well pressure by releasing the first attaching means (204) so that the equalizing shear sub (202) will reduce impact force between the equalizing means (400) and the inner of the running tool (100); and Wherein the second attaching means (304) releases the running tool (100) to press an equalizing prong housing (450) connected to the lower end of the running tool (100) down in order to open the equalizing port (430) for equalizing pressure between the upper and the lower of the well.

In another embodiment, the present invention relates to a completion plug for well completion, comprising:

A first attaching means (204) located between the upper part of a running tool (100) and a safety means (200), the safety means (200) comprising a equalizing shear sub (202), and the running tool (100) has internal space that allows internal members to move up and down;

A second attaching means (304) located between the middle part of the running tool (100) and a shearing means (300), the shearing means (300) comprising a shear retainer (302) for retaining shearing force that may occur between a fishing neck (410) and the inner of the running tool (100);

A third attaching means (422) located between the lower part of the running tool (100) and an equalizing means (400), an equalizing means (400) comprising a equalizing body (420) having an equalizing port (430) inside it and the fishing neck (410) for fishing the shearing means (300) to the equalizing means (400);

Wherein the completion plug is configured to equalize the well pressure by releasing the first attaching means (204) so that the equalizing shear sub (202) will reduce impact force between the equalizing means (400) and the inner of the running tool (100); and Wherein the third attaching means (422) releases the equalizing means (400) from the running tool (100) in order to make the bottom sub (500) close the well when the well is not in use for production.

The completion plug according to this invention has the damage protection member to protect the device and members, fast equalizing time, and can perform both equalizing and plugging, which are selected from releasing the attaching means inside the device.

Any objectives and aspects of this invention will be clearer appear when considered together with the appended drawings and the best mode or preferred embodiment of the invention as described in the followings.

DESCRIPTION OF THE INVENTION

Figure 1:
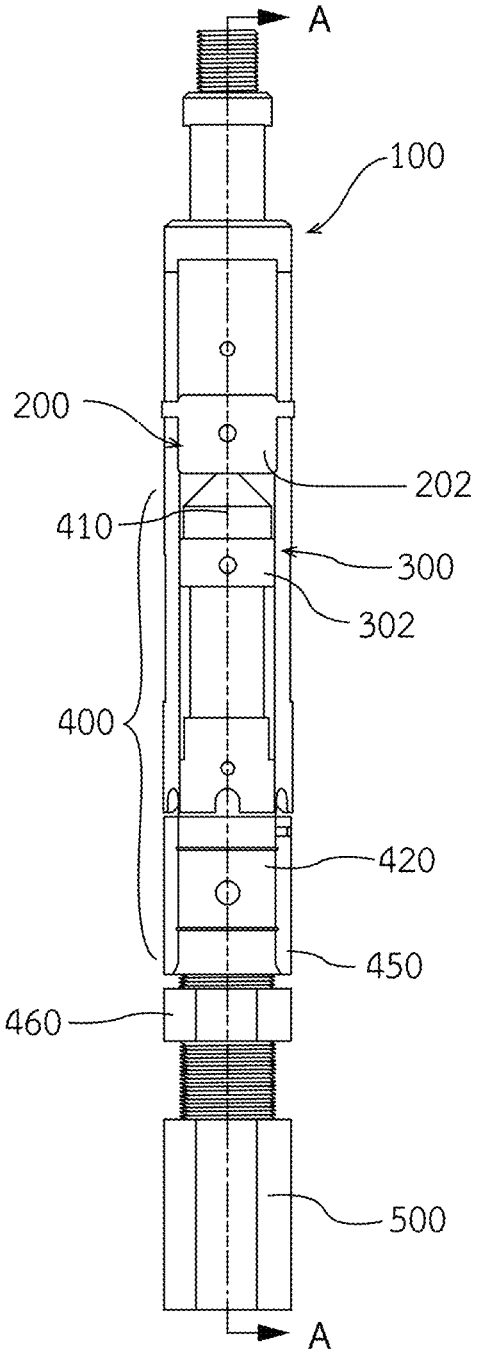
FIG. 1 shows an alignment of internal members of the completion plug according to the exemplary embodiment of this invention.

The present invention relates to a completion plug for well completion.

In one embodiment, the completion plug for equalizing pressure in well comprising:

A first attaching means (204) located between the upper part of a running tool (100) and a safety means (200), the safety means (200) comprising a equalizing shear sub (202), and the running tool (100) has internal space that allows internal members to move up and down;

A second attaching means (304) located between the middle part of the running tool (100) and a shearing means (300), the shearing means (300) comprising a shear retainer (302) for retaining shearing force that may occur between a fishing neck (410) and the inner of the running tool (100);

A third attaching means (422) located between the lower part of the running tool (100) and an equalizing means (400), an equalizing means (400) comprising a equalizing body (420) having an equalizing port (430) inside it and the fishing neck (410) for fishing the shearing means (300) to the equalizing means (400);

Wherein the completion plug is configured to equalize the well pressure by releasing the first attaching means (204) so that the equalizing shear sub (202) will reduce impact force between the equalizing means (400) and the inner of the running tool (100); and Wherein the second attaching means (304) releases the running tool (100) to press an equalizing prong housing (450) connected to the lower end of the running tool (100) down in order to open the equalizing port (430) for equalizing pressure between the upper and the lower of the well.

In another embodiment, the present invention relates to a completion plug for well completion, comprising:

A first attaching means (204) located between the upper part of a running tool (100) and a safety means (200), the safety means (200) comprising a equalizing shear sub (202), and the running tool (100) has internal space that allows internal members to move up and down;

A second attaching means (304) located between the middle part of the running tool (100) and a shearing means (300), the shearing means (300) comprising a shear retainer (302) for retaining shearing force that may occur between a fishing neck (410) and the inner of the running tool (100);

A third attaching means (422) located between the lower part of the running tool (100) and an equalizing means (400), an equalizing means (400) comprising a equalizing body (420) having an equalizing port (430) inside it and the fishing neck (410) for fishing the shearing means (300) to the equalizing means (400);

Wherein the completion plug is configured to equalize the well pressure by releasing the first attaching means (204) so that the equalizing shear sub (202) will reduce impact force between the equalizing means (400) and the inner of the running tool (100); and Wherein the third attaching means (422) releases the equalizing means (400) from the running tool (100) in order to make the bottom sub (500) close the well when the well is not in use for production.

Any aspects described herein are aimed to include the application to the other aspects of this invention, unless stated otherwise.

Technical terms or scientific terms used herein have definitions as understood by persons skilled in the art unless stated otherwise.

The use of singular noun or pronoun, or plural nouns or pronouns with "comprising" in the claims or in the specification refers to "one" and including "one or more", "at least one", and "one or more than one".

Throughout this application, unless being stated otherwise:

Hereafter, detailed description of the invention will be described without any purpose to limit any scope of the invention.

FIG. 1 shows an alignment of internal members of a completion plug for well completion according to the present invention, wherein the running tool (100) is a housing with internal space that allows a safety means (200), a shearing means (300), and an equalizing means (400) to be inside the running tool (100). The safety means (200), the shearing means (300), and the equalizing means (400) can be movable inside the running tool (100). The safety means (200) comprises an equalizing shear sub (202) inside the top of the running tool (100). A shearing means (300), located under the safety means (200), comprises a shear retainer (302) which is a housing covering an equalizing means (400). Said equalizing means (400) comprises a fishing neck (410) and an equalizing body (420). The fishing neck (410) is located under the safety means (200), and is a cylinder shape having larger diameter of the upper end than the lower part for fishing the shearing means (300). The equalizing body (420) is a cylinder shape having equalizing port (430) inside it (not shown in FIG. 1). The upper end of the equalizing body (420) is attached to the lower end of the fishing neck (410), whereas the lower end of the equalizing body (420) is attached to the bottom sub (500).

Figure 2:
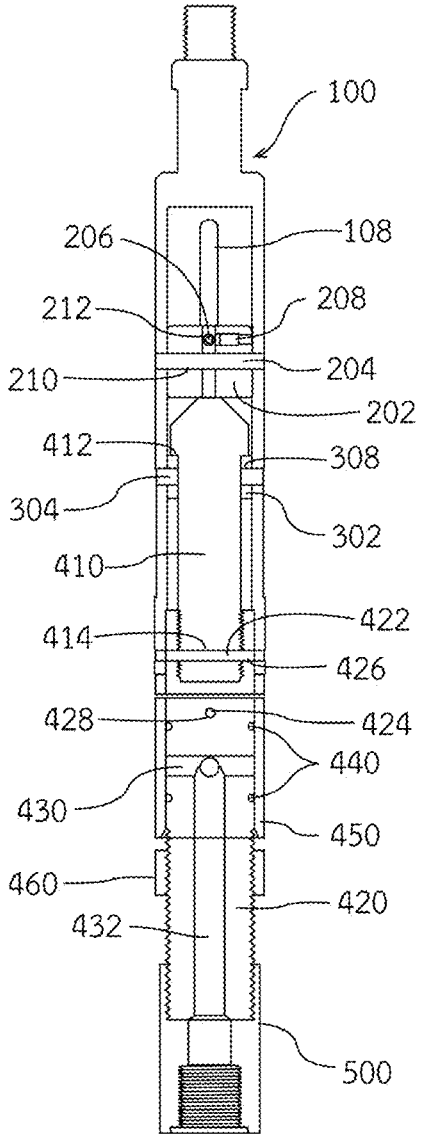
FIG. 2 shows cross-section of the internal members of the completion plug according to the exemplary embodiment of this invention.

FIG. 2 shows a cross-section of the completion plug according to this invention. The upper part of the completion plug according to this invention has a first attaching means (204) which is a protruding part a protruding part configured to be attached between the running tool (100) and the equalizing shear sub (202). The first attaching means (204) attaches the port (210) of the equalizing shear sub (202) inside the running tool (100) in order to prevent the equalizing means (400) from moving up. Moreover, the upper part of the completion plug according to this invention further comprises a first moving means (206), which is a protruding part configured to be attached between upper groove (108) of the running tool (100) and port (212) of the equalizing shear sub (202). Preferably, the port (212) can further comprises a set screw (208) for attaching the first moving means (206) to the port (212). When releasing the first attaching means (204), the first moving means (206) will limit the movement of the safety means (200) to move up and down within space of the upper groove (108).

Moreover, as shown in FIG. 2, the middle part of the completion plug according to this invention has a second attaching means (304) which is a protruding part configured to be attached between the running tool (100) and a shear retainer (302) via port (308) of the shear retainer (302). The shear retainer (302) covers on the fishing neck (410) at the neck 412. Also, the second attaching means (304) attaches the shearing means (300) next to the equalizing means (400) to be immobilized.

Moreover, the lower part of the completion plug according to this invention as shown in FIG. 2 has a third attaching means (422) which is an attaching part configured to be attached between the lower part of the running tool (100) and port 414 of the fishing neck (410) and port (426) of the equalizing body (420). The third attaching means (422) attaches the equalizing body (420) in order not to be separated from the running tool (100) and the fishing neck (410). Moreover, the lower part of the completion plug according to this invention also has a third moving means (424) which is a protruding part configured to be attached between an equalizing prong housing (450) and position (428) of the equalizing body (420). The third moving means (424) blocks and releases the equalizing prong housing (450). The equalizing prong housing (450) is an open end pipe located under the running tool (100) and covering the equalizing body (420). The equalizing body (420) has an equalizing port (430) which is the open port connected to the hollow channel (432) laid inside the equalizing body at the middle part. Preferably, the upper and lower part of the equalizing port (430) has a seal ring 440 for preventing the pressure leak, while the equalizing prong housing (450) is configured to close the equalizing port (430). On the other hand, if the equalizing prong housing (450) has been released, there will be the equalizing of different pressure between the upper and the lower part of the device according to this invention via the equalizing port (430) and the hollow channel (432). Moreover, at the bottom part of the equalizing prong housing (450), there is an adjusting nut (460) covering on the equalizing body (420) for limiting the moving distance of the equalizing prong housing (450). Also, there is the bottom sub (500) attached to the lowest end of the equalizing means (400) for connecting to the underneath devices.

Figure 3:
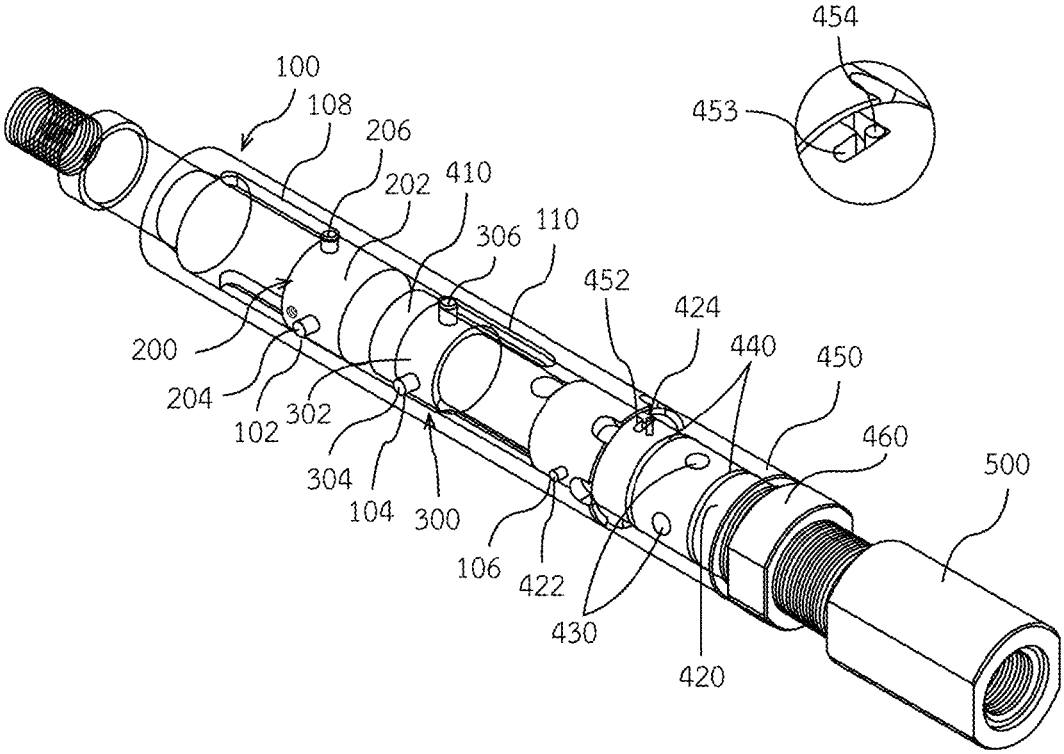
FIG. 3 shows perspective view of the completion plug with according to the exemplary embodiment of this invention that shows the internal mechanicals.

FIG. 3 shows a perspective view, which exhibits the internal mechanism of the completion plug according to this invention. The first attaching means (204) at the upper part of the completion plug according to this invention is a protruding part configured to be attached between the running tool (100) and the equalizing shear sub (202) in order to attach members together via the upper port (102) of the running tool (100) and port (210) (shown in FIG. 2) of the equalizing shear sub (202).

The second moving means (306), at the center of the completion plug according to this invention, is a protruding part configured to be attached between the lower groove (110) of the running tool (100) and the shear retainer (302) in order to limit the movement of the shearing means (300) attached to the equalizing means (400) to move up and down within the lower groove (110) when releasing the second attaching means (304), configured to be attached between the center port 104 of the running tool (100) and the shear retainer (302).

The third moving means (424), at the lower part of the completion plug according to this invention, is a protruding part configured to be attached between a equalizing groove (452) of the equalizing prong housing (450) and the position (428) (shown in FIG. 2) of the equalizing body (420). The third moving means (424) blocks the equalizing prong housing (450) when it is in the blocking position (453) while releasing the equalizing prong housing (450) when it is in the releasing position (454) in order to equalize the different pressure between the upper and the lower parts of the completion plug according to this invention via the equalizing port (430).

According to the specification, the completion plug in this invention is configured to equalize the pressure of the petroleum well by "jarring down" technique via the wireline or cable control connected to the completion plug at the upper end of the running tool (100) for releasing the first attaching means (204). This makes the equalizing shear sub (202) to be able to move up and down within the upper groove (108) by the first moving means (206) in order to reduce the impact force between the equalizing means (400) and the internal part of the running tool (100). The jarring down also releases the second attaching means (304) that makes the running tool (100) to be able to move down to press the equalizing prong housing (450) when the third moving means (424) is in the releasing position (454) to open the equalizing port (430) in order to equalize the different pressure between the upper and the lower parts of the completion plug according to the present invention.

In one embodiment of the present invention, the completion plug according to this invention is configured to equalize the pressure of the well, comprising:

the first attaching means (204) located between the upper part of the running tool (100) and the safety means (200) is released in order to make the safety means (200) to move to be able to reduce the impact force between the equalizing means (400) and the internal part of the running tool (100);

the second attaching means (304) located between the middle part of the running tool (100) and the shearing means (300) is released in order to make the running tool (100) to be movable;

the third attaching means (422) located between the lower part of the fishing neck (410) and the upper part of the equalizing body (420) of the equalizing mean (400), wherein the fishing neck (410) is located next to the safety means (200) and having neck (412) fished to the shearing means (300), wherein the running tool (100) is moved down in order to press the equalizing prong housing (450) at the third moving means (424) to the releasing position 454 in order to open the equalizing port (430) for equalizing the different pressure of the well between the upper and the lower parts of the completion plug.

In one embodiment of the present invention, a method for configuring the completion plug according to this invention to equalize the pressure of the well comprises steps of:

1. Dropping the completion plug according to this invention, of which is connected to the wireline or cable at the upper end position of the running tool (100), into the well in order to install said device in the area desired to separate the tubing system, wherein the bottom sub (500) of the completion plug is connected to the other devices used for well completion inside the well.
2. Adjusting the position of the third moving means (424) in the equalizing (452) to be in the releasing position (454) by controlling via the wireline or cable.
3. Releasing the first attaching means (204) and the second attaching means (304) by jarring down technique by controlling via the wireline or cable.
4. Jarring down, in order to move the running tool (100) down, to press the equalizing prong housing (450) to open the equalizing port (430) for equalizing the different pressure between the upper and the lower parts of said device.

According to the specification, the completion plug according to this invention is configured to close the well by jarring down technique via the control of wireline or cable connected to the upper end position of the running tool (100) to release the first attaching means (204). This enable the equalizing shear sub (202) to move up and down within the upper groove (108) by the first moving means (206) in order to reduce the impact force between the equalizing means (400) and the running tool (100). The jarring down also releases the third attaching means (422) making the equalizing means (400) and the bottom sub (500) under the equalizing body (410) to be released and separated from the running tool (100) to close the well when not in use or before the well is opened for production.

In one embodiment of the present invention, the completion plug according to this invention is configured to close the well, comprising:

the first attaching means (204) located between the upper part of the running tool (100) and the safety means (200) is released in order to make the safety means (200) movable to reduce the impact force between the equalizing means (400) and internal of the running tool (100);

the second attaching means (304) located between the middle part of the running tool (100) and the shearing means (300); and the third attaching means (422) located between the lower part of the running tool (100) and the equalizing means (400), releasing and separating the bottom sub (500) at the lower part of the equalizing body (410) from the running tool (100), in order to close the well when said well is not in use or before the well is opened for production.

In one embodiment of the present invention, a method for configuring the completion plug according to this invention to close the well comprises steps of:

1. Dropping the completion plug according to this invention, of which is connected to the wireline or cable at the upper end position of the running tool (100), into the well in order to install said device in the area desired to separate the tubing system, wherein the bottom sub (500) of the completion plug is connected to the other devices used for well completion inside the well.
2. Releasing the first attaching means (204) and the third attaching means (422) by jarring down technique by controlling via the wireline or cable.

BEST MODE OF THE INVENTION

Best mode or preferred embodiment of the invention is as provided in the description of the invention.

What is claimed is:

1. A completion plug for use in a well, comprising:

a running tool, the running tool formed as an elongated body having an upper part, a lower part, and a first central axis formed through the elongated body of the running tool, the running tool including an internal space formed through the elongated body of the running tool;

a safety assembly, the safety assembly including an equalizing shear sub, the safety assembly housed in the internal space of the running tool, the safety assembly configured to move within the internal space of the running tool along the first central axis;

an equalizing body, the equalizing body housed in the internal space of the running tool, the equalizing body including an equalizing port, wherein the equalizing body is formed as an elongated body having a first end and second end, wherein the equalizing body is arranged in the internal space of the running tool in such a way that the safety assembly is provided between the upper part and the first end of the equalizing body;

wherein, when the completion plug is provided in the well and a pressure differential is present in the well between upper and lower parts of the completion plug:

the completion plug is configured to equalize the pressure differential via the equalizing port of the equalizing body; and the safety assembly is configured to reduce an impact force applied between the first end of the equalizing body and the upper part of the running tool.

2. The completion plug according to claim 1, further comprising a shear retainer, the shear retainer housed in the internal space of the running tool and provided around a perimeter of at least a portion of the equalizing body, the shear retainer configured to manage a shearing force applied to the equalizing body when the pressure differential is applied to the equalizing body.

3. The completion plug according to claim 2, wherein the shear retainer is configured to move within the internal space of the running tool along the first central axis.

4. The completion plug according to claim 3, wherein the shear retainer is configured to remain around the perimeter of at least a portion of the equalizing body.

5. The completion plug according to claim 1, wherein the movement of the equalizing body is a movement along the first central axis.

6. The completion plug according to claim 1, wherein the internal space of the running tool includes an opened end at the lower part of the running tool and a closed end at the upper part of the running tool.

7. The completion plug according to claim 1, wherein the internal space of the running tool is formed as a hollow cylindrical channel.

8. The completion plug according to claim 1, wherein the safety assembly includes a safety assembly body formed as a cylindrical body.

9. The completion plug according to claim 1, wherein the equalizing body is formed as a cylindrical body.

10. The completion plug according to claim 1, wherein the shear retainer is formed as a cylindrical body.

11. The completion plug according to claim 1, wherein the completion plug is provided in the well by inserting the lower part before the upper part.

12. The completion plug with according to claim 1, further comprising a bottom sub, the bottom sub securable to the second end of the equalizing body.

13. A completion plug for use in a well, comprising:

a running tool, the running tool formed as an elongated body having an upper part, a lower part, and a first central axis formed through the elongated body of the running tool, the running tool including an internal space formed through the elongated body of the running tool;

a safety assembly, the safety assembly including an equalizing shear sub, the safety assembly housed in the internal space of the running tool, the safety assembly configured to move within the internal space of the running tool along the first central axis;

an equalizing body, the equalizing body housed in the internal space of the running tool, the equalizing body including an equalizing port, wherein the equalizing body is formed as an elongated body having a first end and second end;

wherein, when the completion plug is provided in the well and a pressure differential is present in the well between upper and lower parts of the completion plug:

the completion plug is configured to equalize the pressure differential via the equalizing port of the equalizing body; and the safety assembly is configured to reduce an impact force applied between the first end of the equalizing body and the upper part of the running tool.

14. The completion plug according to claim 13, wherein the movement of the equalizing body is a movement along the first central axis.

15. The completion plug according to claim 13, wherein the internal space of the running tool includes an opened end at the lower part of the running tool and a closed end at the upper part of the running tool.

16. The completion plug according to claim 13, wherein the internal space of the running tool is formed as a hollow cylindrical channel.

17. A completion plug for use in a well, comprising:

a running tool, the running tool formed as an elongated body having an upper part, a lower part, and a first central axis formed through the elongated body of the running tool, the running tool including an internal space formed through the elongated body of the running tool;

a safety assembly, the safety assembly including an equalizing shear sub, the safety assembly housed in the internal space of the running tool, the safety assembly configured to move within the internal space of the running tool along the first central axis;

an equalizing body, the equalizing body housed in the internal space of the running tool, the equalizing body including an equalizing port, wherein the equalizing body is formed as an elongated body having a first end and second end;

a shear retainer, the shear retainer housed in the internal space of the running tool and provided around a perimeter of at least a portion of the equalizing body;

wherein, when the completion plug is provided in the well and a pressure differential is present in the well between upper and lower parts of the completion plug:

the completion plug is configured to equalize the pressure differential via the equalizing port of the equalizing body;

the shear retainer is configured to manage a shearing force applied to the equalizing body when the pressure differential is applied to the equalizing body; and the safety assembly is configured to reduce an impact force applied between the first end of the equalizing body and the upper part of the running tool.

18. The completion plug according to claim 17, wherein the shear retainer is configured to move within the internal space of the running tool along the first central axis.

19. The completion plug according to claim 17, wherein the shear retainer is configured to remain around the perimeter of at least a portion of the equalizing body.

20. The completion plug according to claim 17, wherein at least one of the following apply:

the internal space of the running tool includes an opened end at the lower part of the running tool and a closed end at the upper part of the running tool;

the internal space of the running tool is formed as a hollow cylindrical channel;

the equalizing body is formed as a cylindrical body;

the shear retainer is formed as a cylindrical body; and/or the completion plug is provided in the well by inserting the lower part before the upper part.

* * * * *